United States Patent [19]

Harris

[11] Patent Number: 4,601,168

[45] Date of Patent: Jul. 22, 1986

[54] NOISE AND EMISSION CONTROL APPARATUS

[76] Inventor: Harold L. Harris, P.O. Box 19835, Houston, Tex. 77024

[21] Appl. No.: 680,804

[22] Filed: Dec. 12, 1984

[51] Int. Cl.[4] ..... F01N 3/28

[52] U.S. Cl. ..... 60/299; 181/255; 422/176; 422/180

[58] Field of Search ..... 60/299; 422/176, 180; 181/255

[56] References Cited

U.S. PATENT DOCUMENTS

| | | | |
|---|---|---|---|
| 2,562,101 | 7/1951 | Hoyle | 181/255 |
| 3,597,165 | 8/1971 | Keith | 422/180 |
| 4,039,294 | 8/1977 | Mayer | 422/171 |
| 4,209,493 | 6/1980 | Olson | 422/180 |

FOREIGN PATENT DOCUMENTS

| | | | |
|---|---|---|---|
| 2504132 | 8/1975 | Fed. Rep. of Germany | 181/255 |

*Primary Examiner*—Douglas Hart

*Attorney, Agent, or Firm*—Bill B. Berryhill

[57] ABSTRACT

Combination noise and emission control apparatus comprising: an enclosed cylindrical housing for connection with the exhaust of an internal combustion engine and including noise reduction components mounted in the housing for reducing noise emitted from the engine and converter components mounted in the housing for reducing noxious gases emitted from the engine.

17 Claims, 2 Drawing Figures

NOISE AND EMISSION CONTROL APPARATUS

BACKGROUND OF THE INVENTION

1. Field of the Invention

The present invention pertains to apparatus for use with internal combustion engines for reducing the noise thereof and for reducing the noxious components of the exhaust gases emitted therefrom. More specifically, the present invention pertains to apparatus particularly suitable for use with natural gas fueled engines to silence the exhaust thereof and to reduce the nitrogen oxides, carbon monoxides and unburned hydrocarbons from the exhaust of such engines.

2. Brief Description of the Prior Art

Silencers or mufflers for internal combustion engines have existed for many years. Most industrial silencers utilize some type of shell or housing in which is mounted various types of baffles for reducing the noise produced at the exhaust of an internal combustion engine.

In recent years, attention has also been directed to reducing the noxious gases emitted in the exhaust of an internal combustion engine, e.g. nitrogen oxide, carbon monoxide and other unburned hydrocarbons. As interest and concern in pollution of the atmosphere continue, particularly as reflected in state and federal air regulations, the search continues for effective means for reducing these noxious emissions. Equipment for reducing noxious emissions from internal combustion engines usually provide some type of catalyst which converts the gases to water, nitrogen, carbon dioxide and other harmless emissions.

Most exhaust emission control apparatus, particularly those for silencing and reducing the noxious emissions of internal combustion engines in industrial applications utilize separate devices for noise reduction and noxious gas reduction. This probably results from the fact that silencers or mufflers are commonly made by one company and catalytic converters by another company. Since these devices are made separately but must be connected in series to an engine exhaust, the pressure drop therethrough is relatively great, resulting in decreased fuel efficiency. In addition to increased operating expense, two separate units result in greater installation cost.

SUMMARY OF THE INVENTION

The present invention provides combination noise and emission control apparatus for use with an internal combustion engine which includes a single enclosed cylindrical housing having an inlet at one end thereof for connection with the exhaust of the engine and an outlet at the opposite end. Noise reduction components are mounted in the housing for reducing the noise emitted from the engine. Catalytic converter components are also mounted in the housing for reducing noxious gases emitted from the engine.

The catalytic converter includes a catalytic cell transversely disposed in the housing so as to separate an upstream portion of the housing from a downstream portion thereof. The catalytic cell converts nitrogen oxide, carbon monoxides and unburned hydrocarbons entering the upstream portion of the housing with the exhaust gases from the internal combustion engine to less noxious compounds in the downstream portion of the housing for discharge through the outlet. The noise reduction components include at least one tubular member, the axis of which coincides with the axis of the housing and the walls of which are perforated by a plurality of holes.

Thus, the combination noise and emission control apparatus of the present invention provides both noise and emission control in a single cylindrical housing so that some of the parts which are normally duplicated in systems utilizing separate noise and emission control devices are combined for common usage. This results in reduced installation and maintenance cost. Most importantly, the pressure drop is substantially reduced, e.g. fifty percent, as compared to systems utilizing separate noise and emission control apparatus. This results in substantial fuel savings.

Many other objects and advantages of the invention will be apparent from reading the description which follows in conjunction with the accompanying drawings.

DESCRIPTION OF A PREFERRED EMBODIMENT

Figure 1:
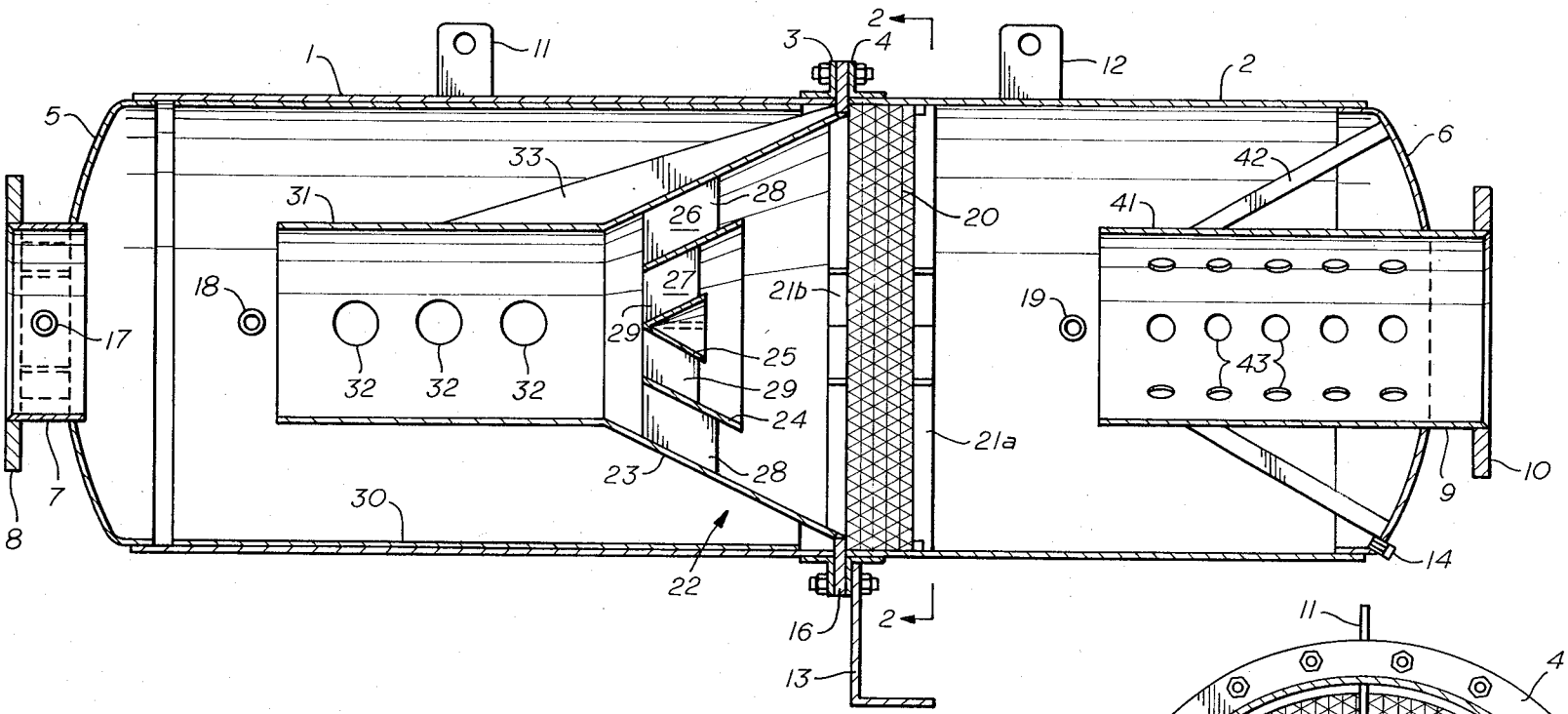
FIG. 1 is a longitudinal view, in section, of combination noise and emission control apparatus according to a preferred embodiment of the invention.
Figure 2:
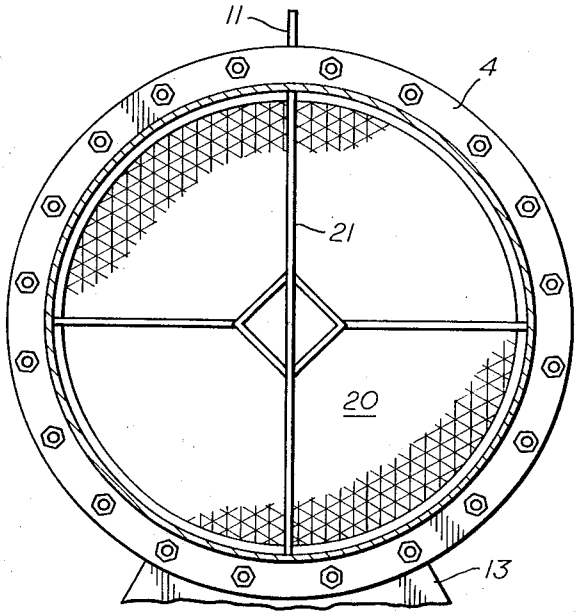
FIG. 2 is a cross-sectional view of the combination noise and emission control apparatus of FIG. 1, taken along lines 2—2 thereof.

Referring now to the drawings, the combination noise and emission control apparatus of the present invention will be described. In includes a cylindrical housing in two sections 1 and 2 connected by bolts passing through bolt holes provided in angle flanges 3 and 4. The housing is closed at the ends thereof by heads 5 and 6. The head 5 is provided with an inlet 7 around which is a flange 8 by which the apparatus may be connected to the exhaust (not shown) of an internal combustion engine. The other head 6 is provided with an outlet 9 which may also be provided with a flange 10. Lifting eyes 11 and 12 may be provided for handling of the apparatus and, if desired, a support member 13 may be provided to aid in supporting the apparatus when attached horizontally to an engine exhaust. A drain hole closed by plugs 14 may be provided for draining water from the housing. Other holes or walls 17, 18 and 19 may be provided for sensing oxygen, temperature, pressure, etc.

The housing encloses noise reduction means for reducing the noise emitted from the engine to which the apparatus is attached and converter means for reducing noxious gases emitted from the engine. The converter means may include a catalytic cell 20 transversely disposed in the housing so as to separate an upstream portion of the housing, enclosed by the first section 1, from a downstream portion of the housing, enclosed by section 2. The catalytic cell 20 is normally made of metallic substances and compounds which are effective in converting nitrogen oxide, carbon monoxide and other unburned hydrocarbons to nitrogen, carbon dioxide, water and other harmless products. The catalytic cell 20 may be held in place by retainers 21*a* and 21*b* made up of a plurality of stiffner or retainer members. The retainers 21*a*, 21*b* also support the cell 20 against stress of explosion from backfire.

To aid in diffusing and distributing exhaust gases entering the upstream portion of the housing across the catalytic cell 20 is diffuser assembly 22 may be provided. In the embodiment shown, the diffuser assembly 22 includes a first frustoconical member 23, the base of which is attached to a ring 16 sandwiched between the angle flanges 3 and 4. The ring 16 is provided with holes for receiving the bolts which hold the housing sections 1 and 2 together. A second frustoconical member 24 of smaller diameter and a center cone member 25 are concentrically disposed so as to provide a plurality of flaring annular passageways 26 and 27 by which exhaust gases are diffused across catalytic cell 20. The second frustoconical member 24 and the cone 25 are held in place by a plurality of radial support members 28 and 29. Thus, the diffuser assembly 22 provides one end opening toward the inlet 7 and flaring outwardly to provide a second end opening toward the catalytic cell 20.

The noise reduction means of the apparatus comprises components for low frequency noise reduction within the first section 1 of the housing and components for high frequency noise reduction in the second portion 2 of the housing. The low frequency components include a cylindrical liner or deadner strip 30 within housing section 1 for damping noise. In addition, it includes a tubular member 31, the axis of which coincides with the axis of the cylindrical housing having a first end which is open toward the inlet 7 and the second end of which is attached to the diffuser assembly 22. Gusset 33 supports tubular member 31 in its attachment to the diffuser assembly 22. Thus, exhaust gases entering the housing through the inlet 7 must pass through the tubular member 31 and the diffuser assembly 32 before passing through the catalyst cell 20.

The walls of the tubular member 31 are perforated preferably by two opposing rows of holes 32 so as to allow some of the exhaust gases to enter the tubular member 31 therethrough. The total cross-sectional area of the wall perforations 32 is preferably in a range of from fifteen percent to twenty-five percent of the cross-sectional area of the tubular member 31. The length of the tubular member 31 is preferably from two and a half to five times the diameter of the tubular member 31.

Although the exemplary embodiment shows a single tube 31 and diffuser assembly 22, it should be understood that in some cases, a plurality of tubes and diffuser assemblies may be provided. They may be concentrically mounted and are dispossed on parallel axes.

The high frequency noise reduction components include a second tubular member 41 having a first end which opens downstream of the catalyst cell 20 and a second end attached to the outlet 9, or actually formed with the outlet 9, so that the converted exhaust gases leaving the catalyst cell 20 are directed through the second tubular member 41 to the outlet 9. Braces 42 may support the tubular member 41 within the second housing portion 2. The walls of the second tubular member 41 are perforated by a plurality of holes 43 so as to allow some of the exhaust gases to enter the second tubular member 41 therethrough for discharge through the outlet 9. The holes 43 are preferably of a smaller diameter than the holes 32 of the first tubular member 31. The total cross-sectional area of the holes 43 is preferably in the range of from fifteen percent to twenty-five percent of the cross-sectional area of the second tubular member 41. The length of the tubular member 41 should be a minimum of twice the diameter thereof.

There are some other dimensions and relationships of the apparatus which are critical. For example, the length of the housing, including both sections 1 and 2, should be in the range of two and one half to five times the diameter thereof. In addition, the catalyst cell 20 should be located at a minimum of fifty-seven percent of the length of the housing from the inlet 7.

The combination noise and emission control apparatus of the present invention thus results in a compact assembly which takes up less space, costs less to manufacture and install. Most importantly, the design results in less pressure drop, resulting in lower fuel consumption.

While a single embodiment of the invention has been described herein, many variations can be made without departing from the spirit of the invention. Thus, it is intended that the scope of the invention be limited only by the claims which follow.

What is claimed is:

1. Combination noise and emission control apparatus for use with an internal combustion engine comprising:

an enclosed cylindrical housing having an inlet at one end thereof for connection with the exhaust of said engine and having an outlet at the opposite end thereof;

noise reduction means mounted in said housing for reducing the noise emitted from said engine, said noise reduction means including at least one tubular member having a first end which opens toward said inlet and a second end opposite therefrom;

converter means mounted in said housing for reducing noxious gases emitted from said engine, said converter means including a catalytic cell, transversely disposed in said cylindrical housing so as to separate an upstream portion of said housing from a downstream portion of said housing, for converting nitrogen oxides, carbon monoxides and unburned hydrocarbons entering said upstream portion of said housing with said exhaust gases to less noxious compounds in said downstream portion of said housing for discharge through said outlet; and diffuser means connected to said second end of said noise reduction means tubular member and disposed in said cylindrical housing between said catalytic cell and said inlet to diffuse and distribute said exhaust gases entering said upstream portion of said housing across said catalytic cell.

2. Combination noise and emission control apparatus as set forth in claim 1 in which said diffuser means comprises at least one frustoconical member having a first end opening toward said inlet and flaring outwardly to provide a second end opening toward said catalytic cell.

3. Combination noise and emission control apparatus as set forth in claim 2 in which said diffuser comprises a plurality of said frustoconical members of different diameters concentrically disposed so as to provide a plurality of flaring annular passageways by which said exhaust gases are diffused across said catalytic cell.

4. Combination noise and emission control apparatus as set forth in claim 1 in which the walls of said tubular member are perforated by a plurality of holes so as to allow some of said exhaust gases to enter said tubular member therethrough.

5. Combination noise and emission control apparatus as set forth in claim 4 in which the total cross-sectional area of said wall perforations is in the range of from 15% to 25% of the cross-sectional area of said tubular member.

6. Combination noise and emission control apparatus as set forth in claim 1 in which said noise reduction means comprises a second tubular member having a first end which opens downstream of said catalyst member and a second end attached to said outlet so that the converted enhaust gases leaving said catalyst cell are directed through said second tubular member to said outlet.

7. Combination noise and emission control apparatus as set forth in claim 6 in which the walls of said second tubular member are perforated by a plurality of holes so as to allow some of said exhaust gases to enter said second tubular member therethrough for discharge through said outlet.

8. Combination noise and emission control apparatus as set forth in claim 7 in which the total cross-sectional area of said wall perforations is in a range of from 15% to 25% of the cross-sectional area of said second tubular member.

9. Combination noise and emission control apparatus as set forth in claim 1 in which said noise reduction means comprises a first tubular member disposed in said cylindrical housing upstream of said converter means for reducing low frequency noise emitted from said engine and a second tubular member disposed in said housing downstream of said converter means for reducing high-frequency noise emitted from said engine.

10. Combination noise and emission control apparatus as set forth in claim 9 in which said first tubular member is opened at each end thereof, one end for receiving exhaust gases from said inlet and the opposite end for directing said exhaust gases across said converter means, said second tubular member being opened at both ends, one end for receiving converted exhaust gases from said converter means and the other end for fluid communication with said outlet through which said converted exhaust gases are discharged.

11. Combination noise and emission control apparatus as set forth in claim 10 in which the walls of said first and second tubular members are perforated by a plurality of holes, the holes of said first tubular member being larger than the holes of said second tubular member.

12. Combination noise and emission control apparatus as set forth in claim 10 in which said converter means includes a catalytic cell, transversely disposed in said cylindrical housing, for converting nitrogen oxides, carbon monoxides and unburned hydrocarbons to less noxious compounds for discharge through said second tubular member and said outlet.

13. Combination noise and emission control apparatus as set forth in claim 12 including diffuser means disposed in said cylindrical housing between said opposite end of said first tubular member and said catalytic cell to diffuse and distribute said exhaust gases across said catalytic cell.

14. Combination noise and emission control apparatus as set forth in claim 13 in which said diffuser means comprises at least one frustoconical member, having a first end opening toward said inlet and flaring outwardly to provide a second end opening toward said catalytic cell.

15. Combination noise and emission control apparatus as set forth in claim 1 in which the ratio of the length of said cylindrical housing to the diameter thereof is in the range of 2.5 to 1 and 5.0 to 1.

16. Combination noise and emission control apparatus as set forth in claim 1 in which the distance from said cylindrical housing inlet to said catalytic cell is at least 57% of the length of said cylindrical housing.

17. Combination noise and emission control apparatus as set forth in claim 6 in which the length of said tubular members is at least twice the diameter thereof.

* * * * *